United States Patent [19]

Iwasaki et al.

[11] 4,075,890

[45] Feb. 28, 1978

[54] DEVICE FOR DETECTING LEVEL OF MOLTEN METAL SURFACE WITHIN A CONTINUOUS CASTING MOLD

[75] Inventors: Takeshi Iwasaki, Tokyo; Yasuo Fujikawa; Kunimasa Sasaki, both of Hiroshima, all of Japan

[73] Assignee: Mitsubishi Jukogyo Kabushiki Kaisha, Tokyo, Japan

[21] Appl. No.: 747,250

[22] Filed: Dec. 2, 1976

[30] Foreign Application Priority Data

Mar. 31, 1976 Japan ..... 51-34278

[51] Int. Cl.[2] ..... G01F 23/22; H01F 27/16

[52] U.S. Cl. ..... 73/295; 336/57; 340/228 F

[58] Field of Search ..... 73/290 R, 295, 362 CP, 73/DIG. 5; 324/34 TE; 335/208; 336/57; 340/228 F

[56] References Cited

U.S. PATENT DOCUMENTS

| | | | |
|---|---|---|---|
| 3,220,258 | 11/1965 | Rod | 73/290 R |
| 3,456,714 | 7/1969 | Weiss | 73/295 X |
| 3,838,372 | 9/1974 | Damijonaitis | 336/96 X |
| 3,864,973 | 2/1975 | Petry | 73/295 |
| 3,891,861 | 6/1975 | Weber et al. | 73/362 CP X |

*Primary Examiner*—Richard C. Queisser

*Assistant Examiner*—John S. Appleman

*Attorney, Agent, or Firm*—Wenderoth, Lind & Ponack

[57] ABSTRACT

A device for detecting the level of the molten metal surface within a continuous casting mold. A detector element consisting of a body of a thermosensitive magnetic material, the magnetic properties of which vary in response to a temperature variation, is mounted at an appropriate position on a side wall of the continuous casting mold, and an electromagnetic coil for detecting the magnetic flux in the detector element is contained within a detector box mounted in a water jacket surrounding the mold at a position opposed to the detector element. The molten metal surface level within the mold is detected by detecting a change in the magnetic properties of the detector element by means of the electromagnetic coil. The detector box is detachably mounted in the water jacket, and water supply inlet and outlet means in the detector box guide cooling water through the detector box for cooling the electromagnetic coil within the detector box. A protective casing containing the electromagnetic coil is slidably mounted in a side wall of the detector box toward the mold for movement toward and away from the mold. The casing has an extension thereon projecting toward the mold and is spring-biased towards the mold, whereby a predetermined distance is maintained between the outer side wall of the mold and the protective casing.

4 Claims, 3 Drawing Figures

DEVICE FOR DETECTING LEVEL OF MOLTEN METAL SURFACE WITHIN A CONTINUOUS CASTING MOLD

The present invention relates to improvements in a device for detecting the level of molten metal surface within a mold in a continuous casting machine during operation of the machine.

BACKGROUND OF THE INVENTION AND PRIOR ART

A device is already known for detecting the level of molten metal surface level within a mold in a continuous casting machine by which a local temperature variation of a mold wall is detected and on the basis of the detected signal the level of the molten metal surface can be detected. Such device has a temperature-sensitive element such as a thermocouple or a thermistor mounted on a mold wall so that the level of the molten metal surface level can be detected by detecting a variation in current, voltage or electric resistance in the temperature sensitive element caused by variation in the level of the molten metal surface level. However, since this detecting device requires lead wires extending from the temperature sensitive element on the mold wall or from the terminals thereof, not only can an accidental failure due to poor contact of the lead wires or breaking of the wires occur, but also troublesome disconnection and reconnection of the lead wires is necessary when replacement of the mold takes place, and therefore, especially in the case of tubular molds which are frequently replaced, there is the disadvantage that a lot of labor is required for changing the temperature sensitive element from one mold to the next.

Accordingly, as a solution for overcoming the above-described disadvantage, it has been proposed to use an element of thermo-sensitive magnetic substance or a combination of one element of a thermo-sensitive magnetic substance and a magnet mounted on the mold wall and a magnetic detector element near the wall, so that the level of the molten metal surface within a mold can be detected by detecting the variation in the magnetic properties of said thermo-sensitive magnetic substance caused by temperature variation of the mold wall at the mounting position of the thermo-sensitive magnetic element, and said molten metal surface level is then controlled by a control device that is operable in response to the signal from the magnetic detector, for instance, as disclosed in Japanese Pat. No. Publication No. 28,258/1973 and in prior copending U.S. application Ser. No. 741,019 filed Nov. 11, 1976. Although the above proposals are effective in that the disadvantage of the previous prior art detecting devices with respect to the connection and disconnection of the lead wires is eliminated, still there remain various problems with respect to the mounting structure of a detector element and detector element terminals, a detection error due to temperature variation, and maintenance of the detecting device, and it has been found through subsequent research that there is a need for further improvements in the device for detecting the level of the molten metal surface within a mold in a continuous casting machine.

OBJECT AND BRIEF SUMMARY OF THE INVENTION

It is an object of the present invention to provide a detecting device which can overcome the problems caused by the above-proposed devices for detecting the level of the molten metal surface within a mold by employing an element of a thermo-sensitive magnetic substance and which is extremely reliable and also practical.

This object is achieved according to the present invention by an improvement in a device for detecting the level of the molten metal surface within a continuous casting mold having a detector element consisting of a body of a thermosensitive magnetic material, the magnetic properties of which vary in response to a temperature variation mounted at an appropriate position on a side wall of the continuous casting mold, and an electromagnetic coil for detecting the magnetic flux in said detector element and contained within a detector box mounted in a water jacket surrounding said mold at a position opposed to said detector element, so that a molten metal surface level within the mold can be detected by detecting a change in the magnetic properties of said detector element by means of said electromagnetic coil. The improvement comprises means for detachably mounting said detector box in the water jacket, water supply inlet and outlet means in said detector box for guiding cooling water through said detector box for cooling the electromagnetic coil within the detector box, a protective casing slidably mounted in a side wall of said detector box toward the mold for movement toward and away from the mold, said electromagnetic coil being contained within said protective casing, said casing having an extension thereon projecting toward the mold, and spring means engaging said protective casing for spring-biasing said protective casing towards said mold, whereby a predetermined distance is maintained between the outer side wall of the mold and said protective casing.

BRIEF DESCRIPTION OF THE DRAWINGS

The invention will now be described in greater detail in connection with the accompanying drawings, in which.

DETAILED DESCRIPTION OF THE INVENTION

Before giving a detailed explanation of the device according to the present invention, a description will be given of the general structure of a mold assembly provided with the detecting device according to the present invention.

Figure 1:
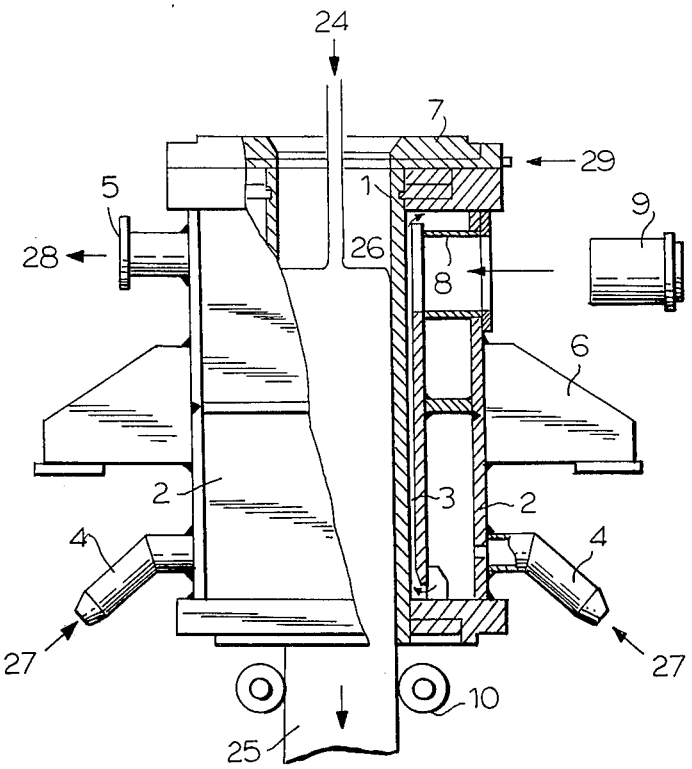
FIG. 1 is a schematic elevation view, partially in longitudinal cross-section, of a conventional mold assembly for continuous casting employing a general tubular mold.

FIG. 1 shows the general structure of a mold assembly employing a tubular mold to be used in a continuous casting machine for casting a tubular billet. As shown in this figure, the tubular mold 1 comprises a tubular body made of pure copper, open at its opposite ends and provided with a hollow portion having a predetermined casting cross-section shape, and it is inserted into a water jacket 2. Water supply pipes 4 are connected to a lower portion of the water jacket 2, and water discharge pipe 5 is connected to the upper portion of the jacket, so that water 27 is fed into the water supply pipes 4 and flows upwardly at a high speed through the clearance 3 between the mold 1 and the water jacket 2 and acting as a coolant for cooling the mold 1 by cooling the outer wall thereof, and the water which has completed its cooling function is discharged through the water discharge pipe 5 as shown by the arrow 28. In addition, at an upper end portion of the water jacket 2 opposite the position where the molten metal surface level is to be detected is provided an opening 8, and a detector box 9 is adapted to be inserted into and be mounted in the opening 8. On the other hand, at the top portion of the mold 1 is provided a lubricant oil feeding plate 7, and a continuous flow of lubricant for the inner surface of the mold 1 is provided by feeding lubricant oil through the lubricant oil feeding plate 7 as shown by the arrow 29.

This mold assembly is mounted on a vibrating frame (not shown) by support arms 6, and vertical vibration is applied to the mold 1 while the mold is water-cooled around its outer circumference and is continuously supplied with a lubricant oil to the inner surface thereof. Molten steel is continuously fed into the mold 1 from above, as shown by the arrow 24. The thus fed molten steel is cooled and solidified to form a shell while contacting the water-cooled wall of the mold 1, and is withdrawn downwardly in the form of a cast piece 25 having a cross-section corresponding to that of the mold 1 and is supported and guided by means of rollers 10 so as to be delivered to the next step of the process. In this case, the cast piece 25 is withdrawn at a speed matching the feeding rate of the molten steel, so that the level of the molten metal surface 26 within the mold 1 should be maintained substantially at a fixed position. It is a most important matter in a continuous casting operation to hold the level of the molten metal surface 26 at a fixed position as closely as possible.

Figure 3:
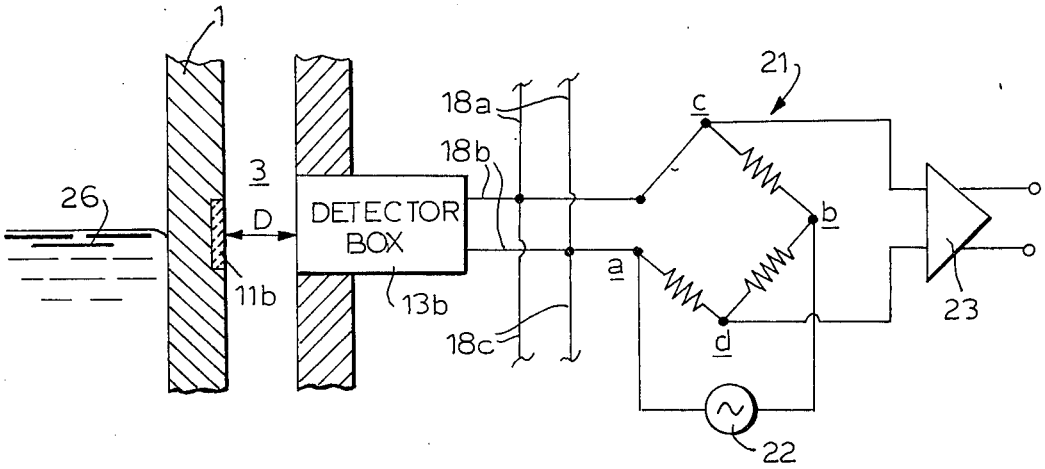
FIG. 3 is a schematic representation of a circuit for producing a signal for a control device according to the invention.
Figure 2:
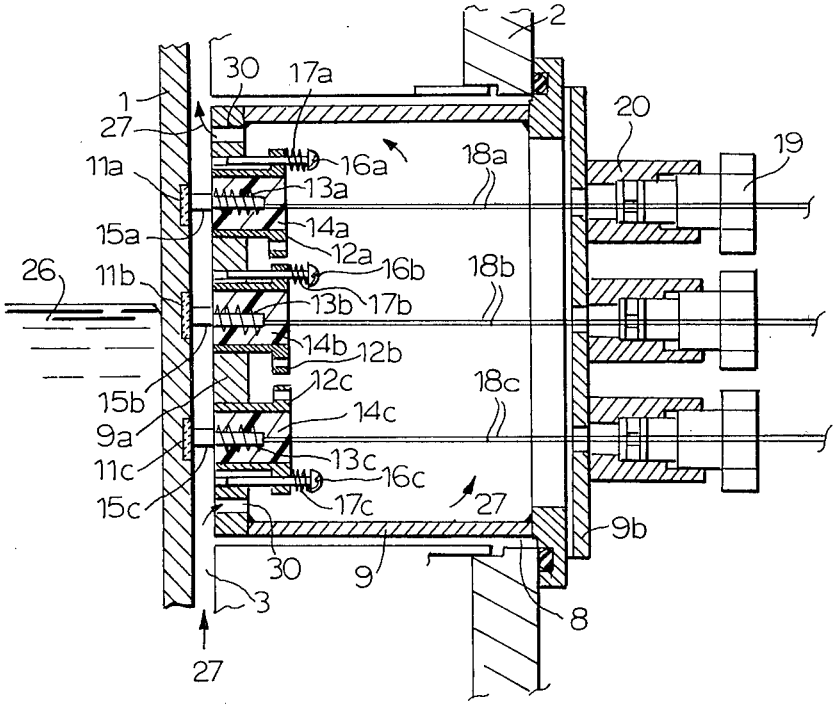
FIG. 2 is a longitudinal cross-section, on an enlarged scale, of the essential parts of the device according to the invention.

The present invention is directed to a device for correctly detecting the level of the molten metal surface 26 as a part of the means to carry out the process of holding the level of the molten metal surface 26 within the mold 1 in said mold assembly at a fixed position, and one preferred embodiment of the invention is illustrated in FIGS. 2 and 3 of the accompanying drawings.

In these figures, as in FIG. 1, reference numeral 1 designates a mold, numeral 2 designates a water jacket, numeral 3 designates a space through which water 27 flows as a coolant, numeral 8 designates an opening in the water jacket 2, and numeral 9 designates a detector box that is fluid-tightly and detachably inserted into said opening 8. The construction, effect and mutual structural relationship of these members are substantially the same as those of the conventional mold assembly employing a tubular mold as shown in FIG. 1. Reference numerals 11*a*, 11*b* and 11*c*, respectively, designate a plurality of detector elements, three detector elements in the illustrated example, adhered to the outer surface, i.e. the surface along which the water coolant passes, of a side wall of the mold 1 by fixing means such as solder or a binder at positions where the level of the molten metal surface is to be detected. In the actual construction, the elements 11*a*–11*c* can be positioned in recesses with their outer surfaces flush with the outer surface of the side wall. These detector elements 11*a*, 11*b* and 11*c* are small pieces of a thin plate, preferably about 5 mm × 20 mm and about 0.2 mm thick, made of thermosensitive magnetic material, the relative magnetic permeability of which varies depending upon temperature, such as, for example "MS" alloy (Fe-Ni-Cr alloy) or Fe-Mn-Zn alloy, and the positions along the outer surface of the side wall of the mold 1 are along the depthwise direction of the mold 1 at appropriate intervals with the center of the array at the reference level of the molten metal surface 26 and the spacing between elements depending upon the range at which each detector element can detect a level change, all as shown in FIG. 2. In the case of the illustrated embodiment, since the detection range of the respective detector elements 11*a*, 11*b* and 11*c* is on the order of about 30 mm, the detector element 11*b* mounted at the position opposite the reference level of the molten metal surface 26 is at the center of the range, and the upper limit detector element 11*a* is mounted at a position spaced 30 mm upwardly from the center, while the lower limit detector element 11*c* is mounted at a position spaced 30 mm downwardly from the center. Reference numerals 12*a*, 12*b* and 12*c*, respectively, designate protective casings which are horizontally and slidably fitted in corresponding bores provided in the side wall of the detector box 9, which is toward the mold 1 at positions opposed to said detector elements 11*a*, 11*b* and 11*c*. These protective casings 12*a*, 12*b* and 12*c*, respectively, have thereon extensions 15*a*, 15*b* and 15*c* of predetermined dimensions extending towards the mold 1 as shown in FIG. 2. The protective casings are mounted on the side wall 9*a* of the detector box 9 on the side toward the mold 1 by means of bolts 16*a*, 16*b* and 16*c* which have compression springs 17*a*, 17*b* and 17*c* therearound between the heads thereof and the casings 12*a*, 12*b* and 12*c*. The protective casings 12*a*, 12*b* and 12*c* are thus always spring-biased towards the mold 1 due to the resilient forces of said compression springs 17*a*, 17*b* and 17*c*, so that the tip ends of the respective extensions 15*a*, 15*b* and 15*c* are lightly urged into contact with the surfaces of said detector elements 11*a*, 11*b* and 11*c*, respectively. Because of the presence of these protrusions 15*a*, 15*b* and 15*c*, a predetermined space or clearance 3 can be maintained between the respective protective casings 12*a*, 12*b* and 12*c* and the side wall of the mold 1. Therefore, the respective protective casings 12*a*, 12*b* and 12*c* will follow the thermal deformations of the side wall of the mold 1 so as to always remain at the predetermined distance from the mold 1. Among other benefits, this assures the continued existence of space 3 for passing the cooling water 27 therethrough.

Reference numerals 13*a*, 13*b* and 13*c* designate electromagnetic coils for detecting magnetic flux which are fixedly mounted within said protective casings 12*a*, 12*b* and 12*c*, respectively, by a filler material such as synthetic resin as shown at 14*a*, 14*b* and 14*c* in FIG. 2, so that the tip ends of these coils are at positions opposed to said detector elements 11*a*, 11*b* and 11*c*, respectively. Since, due to the mounting arrangement and extensions 15*a*, 15*b* and 15*c*, the relative distance between the protective casings 12*a*, 12*b* and 12*c* and the outer surface of the side wall of the mold 1 is always maintained at a fixed distance regardless of the thermal deformation of the side wall of the mold 1, naturally the relative distances between the tip ends of the electromagnetic coil 13*a*, 13*b* and 13*c* and the detector elements 11*a*, 11*b* and 11*c* are also maintained constant. In addition, at the upper and lower portions of the side wall 9*a* of said detector box 9 on the side toward the mold are water communication bores 30 communicating with the clearance 3 and through which water 27 flows, so that the water 27 can flow into the detector box 9 to cool said electromagnetic coils 13*a*, 13*b* and 13*c* and thereby can prevent a temperature rise thereof. Reference numerals 18*a*, 18*b* and 18*c* designate lead wires connected to the respective electromagnetic coils 13*a*, 13*b* and 13*c*, and the other ends of these lead wires 18*a*, 18*b* and 18*c* extend outwardly from the detector box 9 through mounting bosses 20 fixedly secured to the outer side wall 9*b* of the detector box 9 and sealing plugs 19, and are connected to a bridge circuit 21 as described later which is disposed externally of detector box 9.

In FIG. 3, reference numeral 21 designates a bridge circuit having terminals *a*, *b*, *c* and *d* therein, an A.C. power source 22 being connected between the terminals *a* and *b* in the circuit 21, while an amplifier 23 is connected between the terminals *c* and *d*. In this case, although the frequency of the A.C. power source 22 is not specifically limited, normally a frequency on the order of 1–100 KHz is employed. The leads 18*a*, 18*b* and 18*c* are connected in parallel to terminals *a* and *c* of the bridge circuit 21.

The operation of the device for detecting the level of the molten metal surface within a mold constructed as described above will now be explained.

At first, prior to pouring of molten metal into the mold 1, the A.C. power source 22 is connected to the bridge circuit 21, and the respective arms of the bridge circuit, except for the coils 13*a*, 13*b* and 13*c* are preliminarily adjusted so that a voltage will not appear between the output terminals *c* and *d* of the bridge circuit 21. Subsequently, molten steel 24 is poured into the mold 1. The molten steel accumulates within the mold 1, and when the molten metal surface has reached a predetermined reference level of the molten metal surface 26, the temperature of the mold 1 will vary, and in response to the temperature variation, the relative magnetic permeabilities of the detector elements, i.e. the bodies of thermosensitive magnetic material, mounted on the outer surface of the side wall of the mold 1, will vary. Due to this variation of the relative magnetic permeabilities, the magnetic flux through the detector elements magnetized by the lines of magnetic force induced by the electromagnetic coils 13*a*, 13*b* and 13*c* will vary, so that the electromagnetic coupling between the detector elements and electromagnetic coils which jointly form one arm of the bridge circuit is varied, resulting in variation in an electric current flowing through the electromagnetic coil. As a result, a deviation voltage will appear between the terminals *c* and *d* of the bridge circuit 21, and this deviation voltage is amplified by the amplifier 23.

In this way, the output from the amplifier 23 will vary in response to the temperature variation of the side wall of the mold 1, which temperature will vary depending upon the position of the surface of the molten metal 26 within the mold 1, so that the position of the surface of the molten metal 26 within the mold 1 can be detected from the value of the output of the amplifier 23. This output can further be used to control the means for supplying molten metal to the mold 1.

A problem with respect to such a detecting device is that to obtain an output signal having good stability, it is necessary to minimize the influence of external disturbances as much as possible. Among various possible external disturbances, the biggest one is a variation in the distance D (see FIG. 3), between the detector element and the electromagnetic coil for detecting a magnetic flux, and the temperature variation of the electromagnetic coil.

In the device according to the present invention, due to the above-described novel structural features, even if the side wall of the mold 1 should be subjected to thermal deformation, the distances between the respective detector elements 11*a*, 11*b* and 11*c* and the opposed electromagnetic coils 13*a*, 13*b* and 13*c* will always be maintained constant, and the electromagnetic coils are cooled by the water 27, so that a stable output signal can be obtained.

Since the device according to the present invention has the above-described construction and functions, the present invention provides the following practical advantages:

(1) Because the mold 1 can be easily removed from the water jacket 2 without disturbing any of the parts of detector box 9, replacement of the mold 1 can be carried out in a simple and easy manner, and further since the detector elements are very cheap, maintenance of the mold assembly can be readily achieved.

(2) Since the distance between the detector elements and the electromagnetic coils for detecting magnetic flux will not vary even if the side wall of the mold 1 should be subjected to thermal deformation, a stable and highly reliable output signal can be obtained.

(3) Mounting and removal of the electromagnetic coil assembly for detecting the magnetic flux is easy, because the whole assembly is accommodated within the detector box 9.

(4) External disturbances caused by temperature variations of the electromagnetic coils is prevented, because the entire detector box 9 is mounted within the water jacket 2, and further water is passed through the interior of the detector box 9 so as to cool the electromagnetic coils disposed within the detector box 9.

It is to be noted that if a structure is employed in which the detector element is a thin plate and is adhered to the outer surface of the side wall of the mold 1, as in the above-described embodiment, then the advantage exists that a correct temperature variation output is obtained without affecting the cooling and temperature distribution of the mold 1. In addition, if a construction is employed in which a plurality of pairs of detector elements and electromagnetic coils for detecting the magnetic flux are arrayed in the depthwise direction of the mold, then an additional advantage exists in that in addition to detection of the level of the molten metal surface, control of the level of the molten metal surface can be carried out using the signal which acts as the indicator of the level of the molten metal surface.

What is claimed is:

1. In a device for detecting the level of the molten metal surface within a continuous casting mold having a detector element consisting of a body of a thermosensitive magnetic material, the magnetic properties of which vary in response to a temperature variation mounted at an appropriate position on a side wall of the continuous casting mold, and an electromagnetic coil for detecting the magnetic flux in said detector element and contained within a detector box mounted in a water jacket surrounding said mold at a position opposed to said detector element, so that a molten metal surface level within the mold can be detected by detecting a change in the magnetic properties of said detector element by means of said electromagnetic coil, the improvement comprising means for detachably mounting said detector box in the water jacket, water supply inlet and outlet means in said detector box for guiding cooling water through said detector box for cooling the electromagnetic coil within the detector box, a protective casing slidably mounted in a side wall of said detector box toward the mold for movement toward and away from the mold, said electromagnetic coil being contained entirely within said protective casing for being protected against electrical contact with the cooling water, said casing having an extension thereon projecting from the end of said electromagnetic coil toward the mold, and spring means engaging said protective casing for spring-biasing said protective casing towards said mold for keeping the free end of said extension against said mold, whereby a predetermined distance is maintained between the outer side wall of the mold and said protective casing.

2. The improvement as claimed in claim 1 in which said casing has a body of synthetic resin therein for mounting said electromagnetic coil in a fixed position within said protective casing.

3. The improvement as claimed in claim 1 in which said detector element is a thin plate and is adhered to an outer surface of the side wall of the mold.

4. The improvement as claimed in claim 1 further comprising at least one further detector element on said mold and an opposed further electromagnetic coil for detecting a magnetic flux and a further slidably mounted protective casing in said detector box in which said further electromagnetic coil is mounted, the opposed detector elements and electromagnetic elements being at a plurality of positions spaced in the depthwise direction along the mold.

* * * * *